US007931260B2

(12) United States Patent
Pangle et al.

(10) Patent No.: US 7,931,260 B2
(45) Date of Patent: Apr. 26, 2011

(54) SIGNATURE HOPPER WITH LAP STRAIGHTENING DEVICE

(75) Inventors: James Aurthur Pangle, Strasburg, VA (US); Glen Roger Caron, Greenland, NH (US); Gary Cooper, Nottingham, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 12/011,112

(22) Filed: Jan. 24, 2008

(65) Prior Publication Data

US 2008/0122158 A1 May 29, 2008

Related U.S. Application Data

(63) Continuation of application No. 11/657,285, filed on Jan. 24, 2007.

(60) Provisional application No. 60/761,617, filed on Jan. 24, 2006.

(51) Int. Cl.
*B65H 39/04* (2006.01)

(52) U.S. Cl. ..... 270/52.2; 270/52.16; 270/52.19; 270/52.21; 270/52.23; 270/52.25; 270/58.26

(58) Field of Classification Search ..... 270/52.2, 270/52.16, 52.19, 52.21, 52.22, 52.23, 52.25, 270/52.26, 52.29
See application file for complete search history.

(56) References Cited

U.S. PATENT DOCUMENTS

| | | | | |
|---|---|---|---|---|
| 1,418,865 | A | 6/1922 | Christensen | |
| 1,974,243 | A | 9/1934 | Kleinschmit et al. | |
| 2,251,943 | A * | 8/1941 | Kleineberg | 270/52.29 |
| 3,089,693 | A | 5/1963 | Gore et al. | |
| 3,809,384 | A | 5/1974 | Zugel | |
| 4,180,255 | A * | 12/1979 | Himmel | 270/52.27 |
| 4,381,106 | A | 4/1983 | Loebach | 270/47 |
| 4,564,186 | A * | 1/1986 | Clarke et al. | 270/52.29 |
| 4,844,433 | A * | 7/1989 | Hastie | 270/52.27 |
| 5,067,700 | A | 11/1991 | Dick | 270/52.29 |
| 5,100,118 | A | 3/1992 | Hobbs et al. | 270/52.17 |
| 5,114,129 | A | 5/1992 | Chang et al. | |
| 5,769,405 | A | 6/1998 | Glanzmann et al. | 270/52.16 |
| 6,308,945 | B1 | 10/2001 | Sagesser | |

FOREIGN PATENT DOCUMENTS

| | | |
|---|---|---|
| GB | 2060578 A | 5/1981 |
| JP | 580 368 61 (A) | 3/1983 |
| JP | 3111375 (A) | 5/1991 |

* cited by examiner

*Primary Examiner* — Leslie A Nicholson, III
(74) *Attorney, Agent, or Firm* — Davidson, Davidson & Kappel, LLC

(57) ABSTRACT

A storage vessel for holding between shaves a wet razor with its head and cutting blade submerged in a liquid and its handle held out of the liquid and dry. The vessel liquid is comprised of a mixture of hydrophobic and hygroscopic materials and of anti-viral and anti-bacterial materials, effective to reduce cutting blade oxidation due to exposure to water and air during nonuse storage and to maintain the blade sharp and sanitary for shaving comfort. These materials specifically might be mineral oil and calcium chloride ($CaCl_2$), and nano-gold or nano-silver.

19 Claims, 7 Drawing Sheets

SIGNATURE HOPPER WITH LAP STRAIGHTENING DEVICE

CROSS-REFERENCE TO RELATED APPLICATIONS

This is a continuation of U.S. application Ser. No. 11/657,285 filed Jan. 24, 2007, which claims the benefit of U.S. Provisional Application No. 60/761,617 filed Jan. 24, 2006. Both applications are hereby incorporated by reference herein.

BACKGROUND OF THE INVENTION

The present invention relates generally to devices for collecting printed products such as a saddle stitcher, gatherer or inserter, and to methods for collecting printed products.

The Goss SP 1000 saddle stitcher for example has a plurality of hoppers which feed signatures to a saddle conveyor. In each hopper, a drum receives folded signatures from a stack and grips the lead or folded edge of the signature. The signature travels around until it hits a fixed register stop, at which time a dipper blade pushes the open edge of the folded signature toward a second drum. The second drum grips the open edge with a gripper and transfers the signature to a further drum which can open the signature for depositing on a saddle conveyor.

BRIEF SUMMARY OF THE INVENTION

When signatures are wrinkled or the lapped end curls, the transfer between the drum and the second drum can fail or have problems.

The present invention provides a method for retrofitting a saddle stitcher comprising:

adding an arced extension piece to a signature support of a hopper.

The present invention provides a method for retrofitting a saddle stitcher comprising:

removing a dipper blade and adding a dipper blade with a curved end, the curved end facing away from a direction of rotation of a hopper drum.

The present invention also provides a method for operating a saddle stitcher comprising:

adjusting an angle between a register stop and a signature support of a drum.

BRIEF DESCRIPTION OF THE DRAWINGS

A preferred embodiment of the present invention is described below by reference to the following drawings, in which.

DETAILED DESCRIPTION OF THE DRAWINGS

Figure 1:
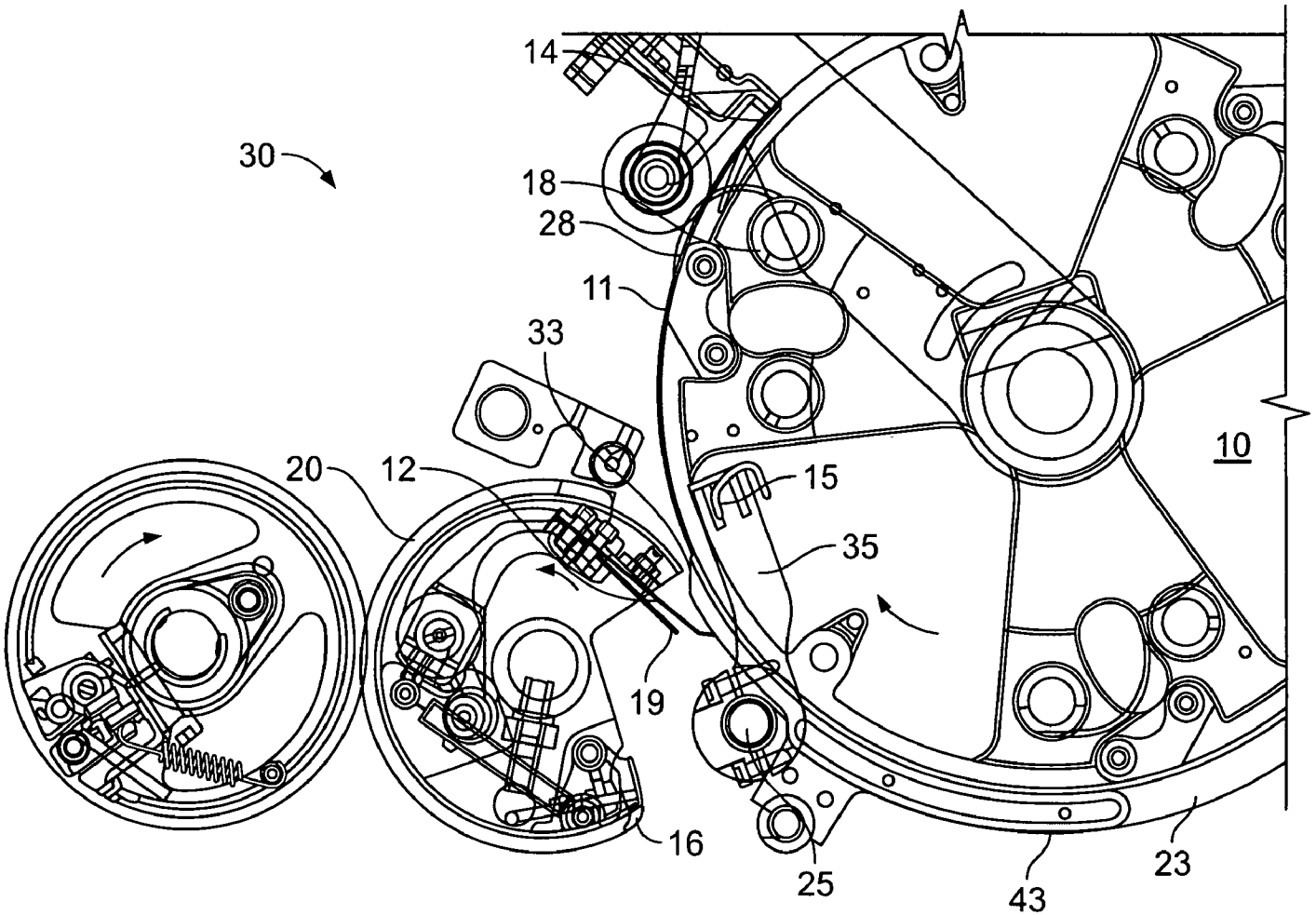
FIG. 1 shows a signature hopper according to the present invention.

FIG. 1 shows a signature hopper 30 having a first drum 10, a second drum 20, a dipper blade 15 and a stationary signature guide with a main section 23 and an extension 43 having an end 33 in a direction of rotation of first drum 10.

First drum 10 includes a plurality of grippers 28 each connected to a support 18, which can rotate to open and close the grippers 28. A stationary register stop 14 for a signature is located next to the first drum 10 and can extend into circumferential grooves in the drum.

Second drum 20 includes a primary gripper 12, a gripper seat 16 and a lap gripper 19. First drum 10 rotates in a clockwise direction while second drum 20 rotates in a counterclockwise direction, as shown.

First drum 10 grips a lead edge of a signature 11 between gripper 28 and an outer surface of the first drum 10 and rotates signature 11 past signature guide 23. Stationary signature guide 23 can smooth out wrinkles in signature 11 and prevent the trailing or open edge from curling away from the outer surface of first drum 10. The trailing edge of signature 11 thus remains between first drum 10 and stationary signature guide 23. Before or when the folded or lead edge of signature 11 hits register stops 14, the grippers 28 open and the signature 11 is prevented from moving further in the direction of rotation of drum 10. Dipper blade 15 at the same time begins to move at least radially with respect to first drum 10. Dipper blade 15 may be cam-activated for example, and rotate about an axis 25 via a support arm 35.

Figure 2:
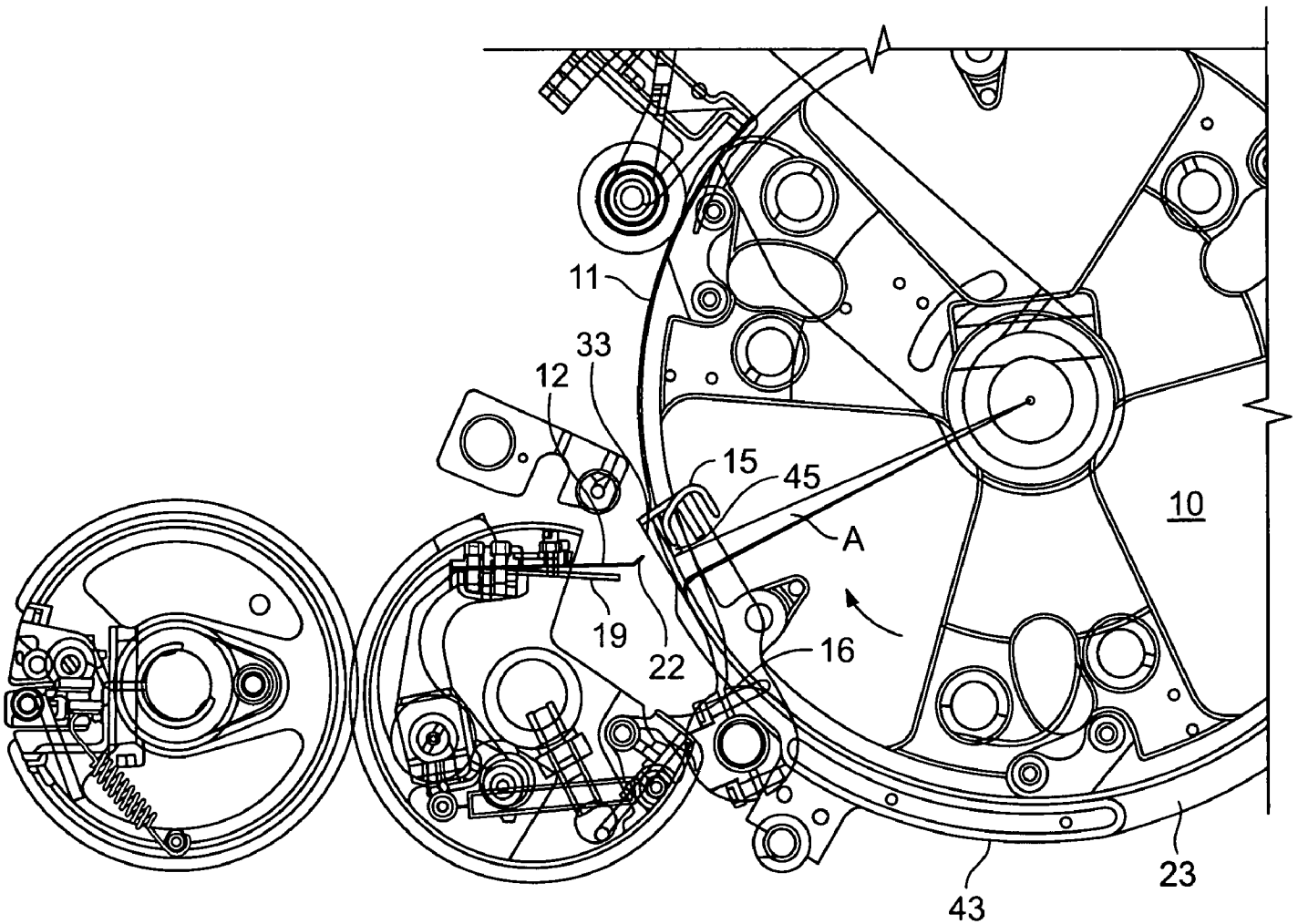
FIG. 2 shows the signature hopper of FIG. 1 with dipper blades contacting a signature.

FIG. 2 shows dipper blade 15 rotating toward signature 11 within a circumferential groove or ends of the first drum 10, and then contacting signature 11. Dipper blade 15 remains in contact with signature 11 until transfer of signature 11 from first drum 10 to the second drum 20 is completed. An angle A represents the distance between an end 45 of the dipper blade 15 opposite the direction of rotation of drum 10 and the stationary signature guide end 33. Angle A is adjustable via the extension 43, which has a slot. Thus, dipper blade 15 contacts signature 11 near the trailing edge of signature 11 at a point where dipper blade 15 does not interfere with stationary signature guide 23. A large portion of dipper blade 15 contacts signature 11 providing adequate signature support, as dipper blade 15 is curved away from the direction of rotation of drum 10.

Figure 3:
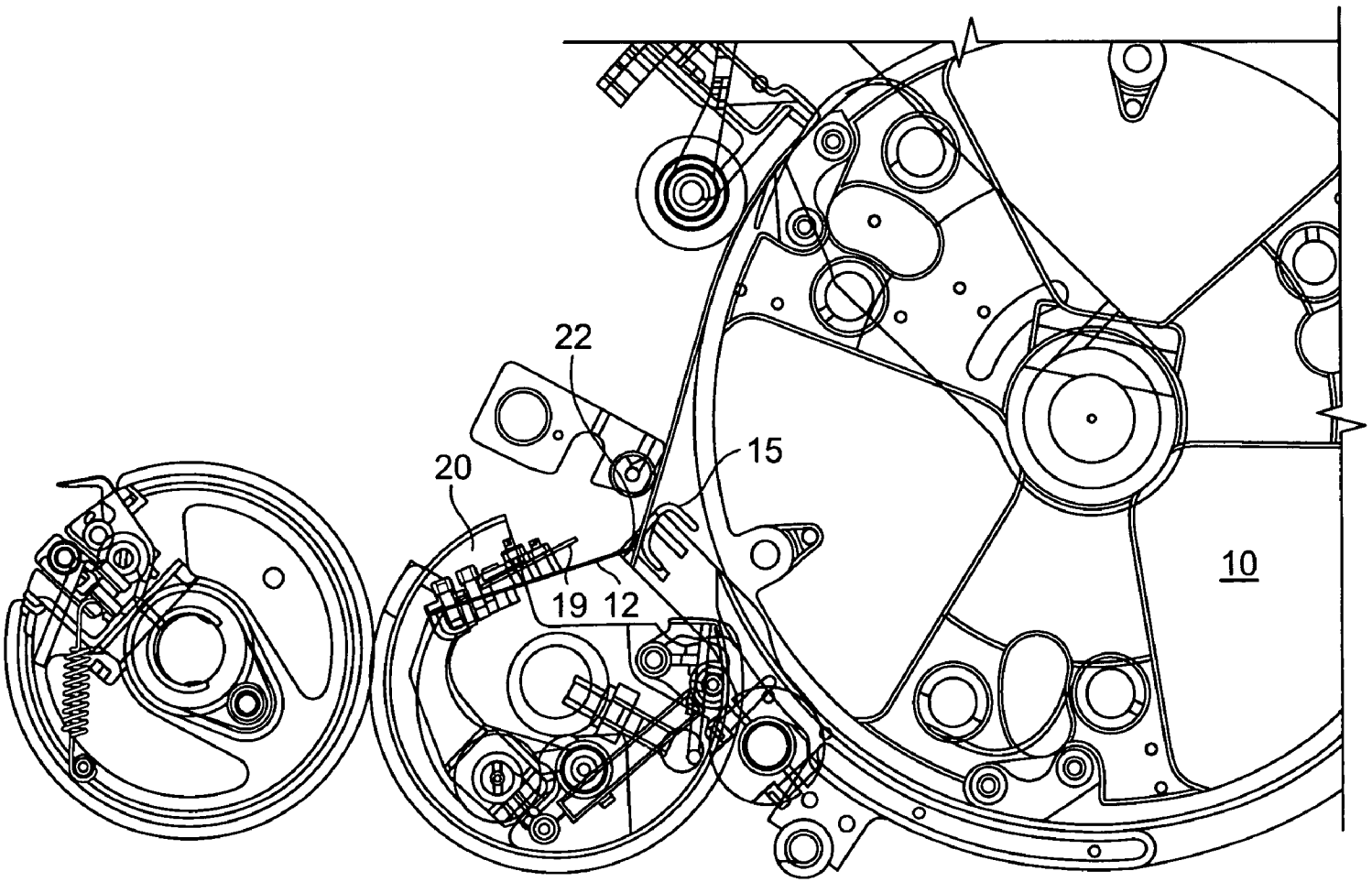
FIG. 3 shows the signature hopper of FIG. 1 with dipper blades forcing the signature against a gripper finger.

FIG. 3 shows dipper blade 15 rotating further away from first drum 10 towards second drum 20 and pushing signature 11 towards second drum 20. Dipper blade 15 remains in contact with signature 11 as first drum 10 continues to rotate. Primary gripper 12 has a curved end 22 which contacts signature 11 as dipper blade 15 pushes signature 11 towards primary gripper 12. Primary gripper 12 begins to close, remaining in contact with signature 11 throughout closing.

Figure 4:
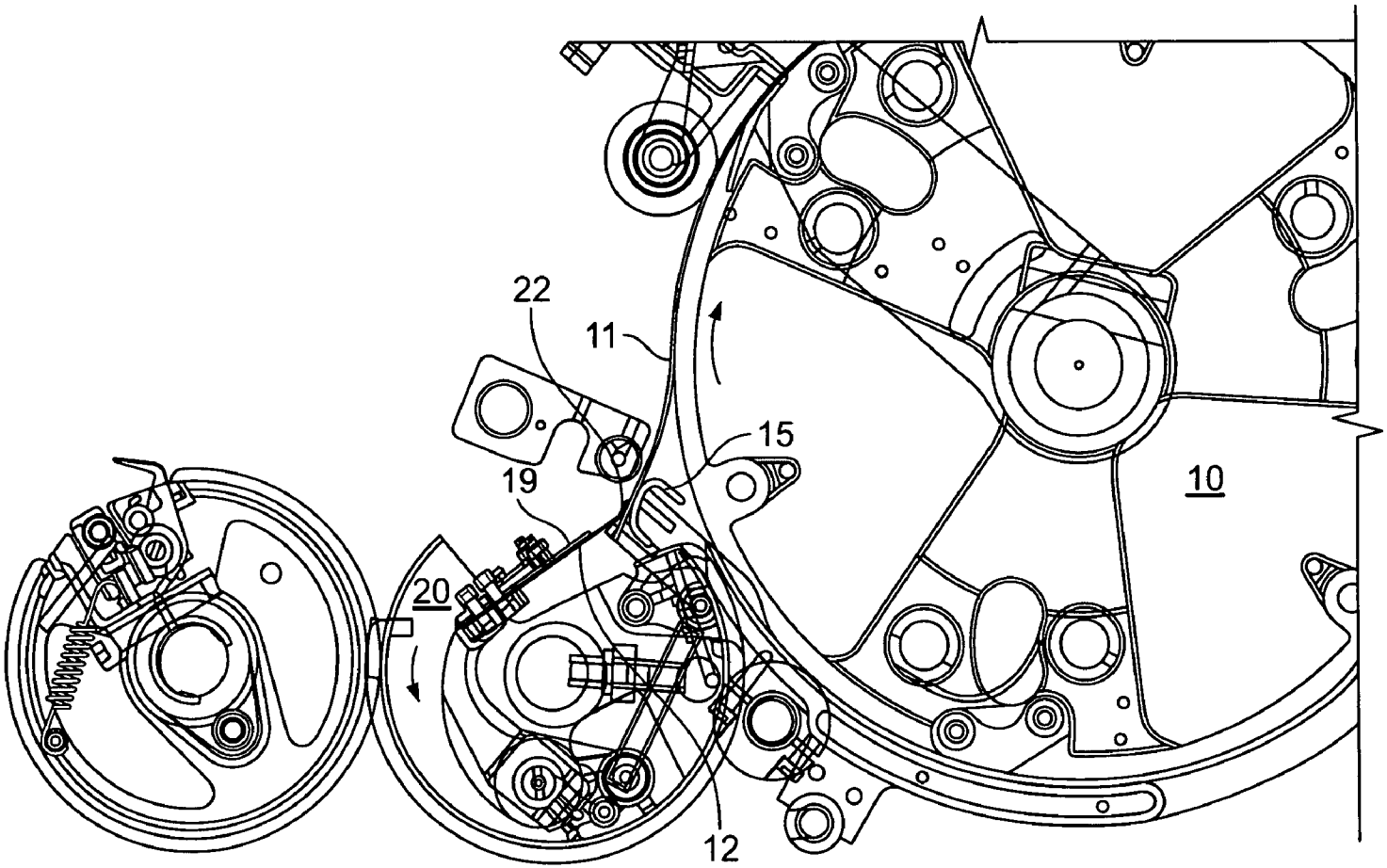
FIG. 4 shows the signature hopper as in FIG. 3 at a further time point.

FIG. 4 shows primary gripper 12 closing on signature 11. Second drum 20 continues rotating in the counterclockwise direction and primary gripper 12 continues closing. As primary gripper 12 closes, dipper blade 15 continues to contact and support signature 11. Thus, signature 11 is fed into primary gripper 12 via dipper blade 15 as first drum 10 and second drum 20 rotate.

Figure 5:
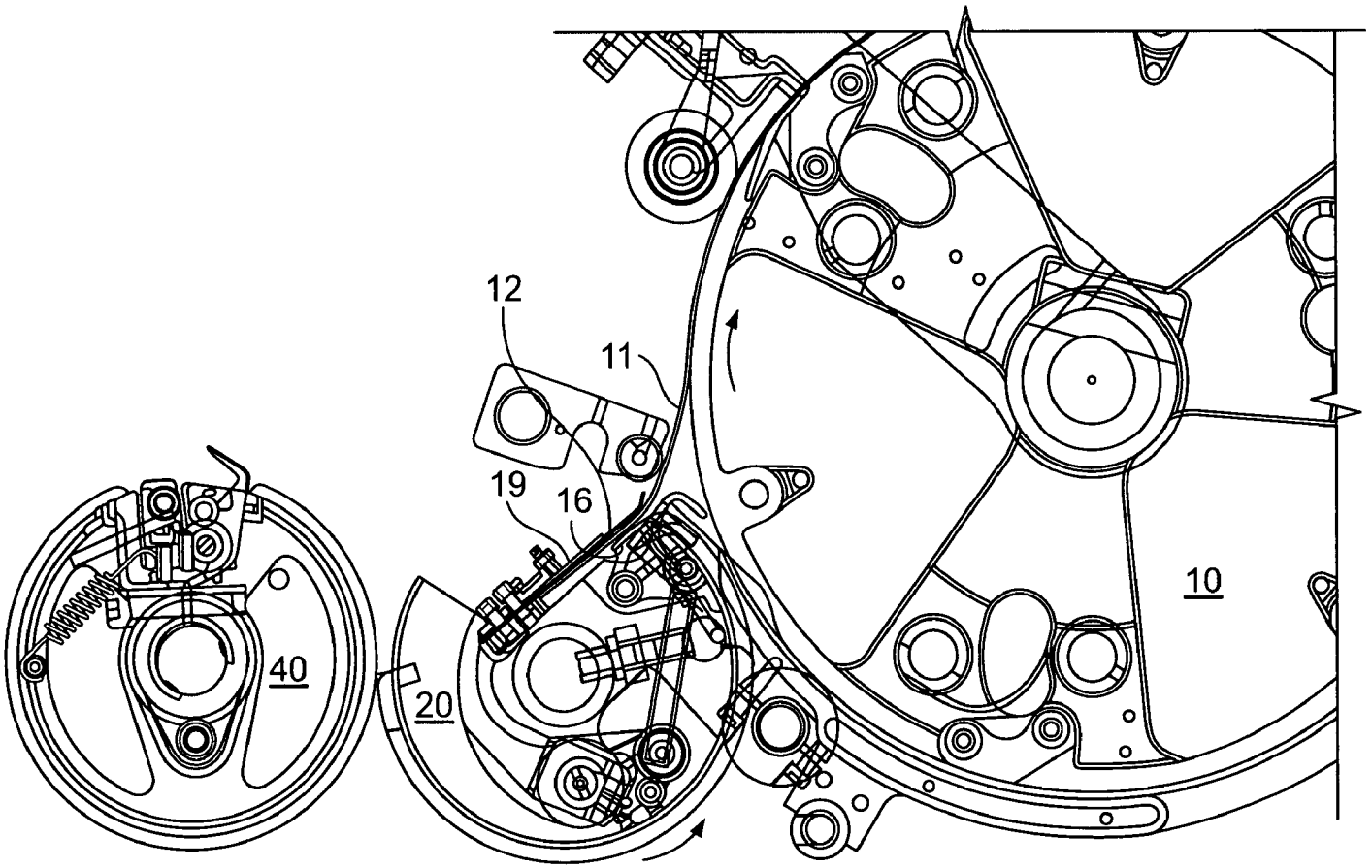
FIG. 5 shows the signature hopper as in FIG. 3 with the second drum gripping the signature.

FIG. 5 shows second drum 20 gripping signature 11 via primary gripper 12, which closes against gripper seat 16. Thus, second drum 20 grips signature 11 by primary gripper 12 against the gripper seat 16, with lap gripper 19 gripping the longer or lapped edge of the signature only. (FIG. 4) A third drum 40 can then receive the gripped signature from drum 20, and transfer it to a saddle conveyor of a saddle stitcher.

Figure 6:
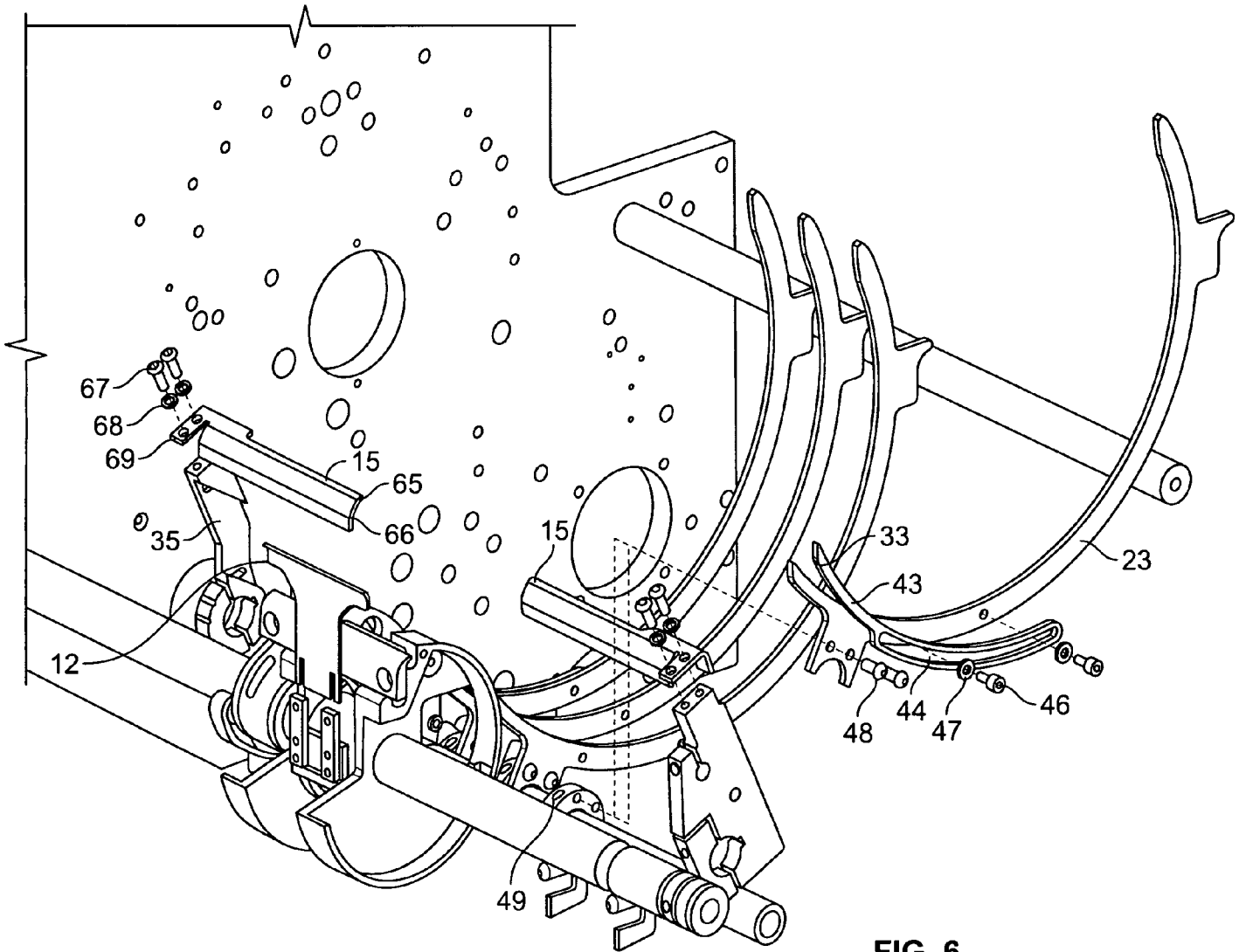
FIG. 6 shows an exploded perspective view of parts of the signature hopper according to the present invention.

FIG. 6 shows an exploded view and the retrofitting of an existing GOSS SP-1100 saddle stitcher. For the four signature supports 23 and extension 43 may be added via bolts 46 and washers 47 through a curved slot 44 of the extension 43. This arrangement advantageously also permits variability of the angular position of end 33. The support 23 is attached via screws 48 for example to a collar 49.

Dipper blades 15 have two bends 65, 66 to provide the advantageous curved profile, and enter the first drum 10 from the ends. The dipper blades 15 are attached via screws 67 and washers 68 and holes 69 to a support 35.

Figure 6A:
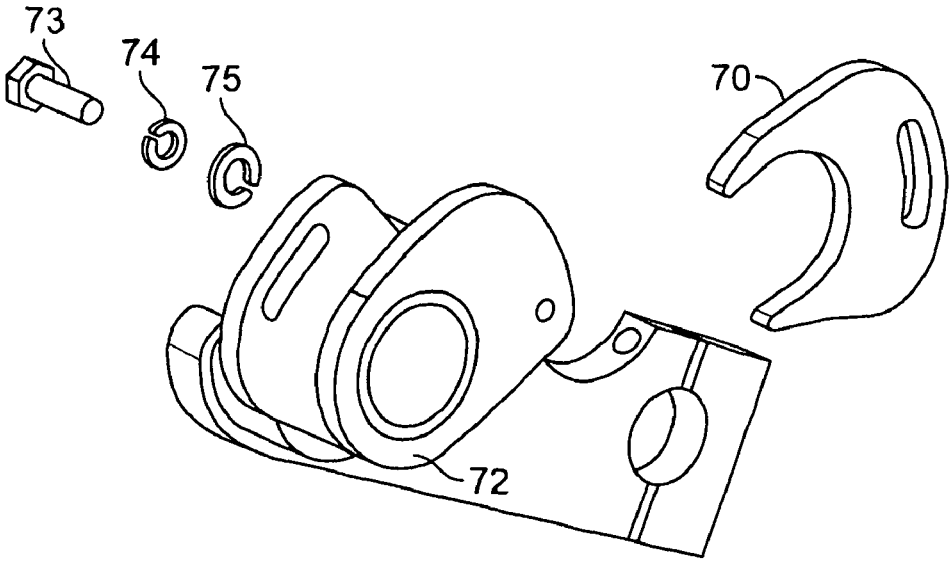
FIG. 6A shows a cam for the gripper of the second drum.
Figure 6B:
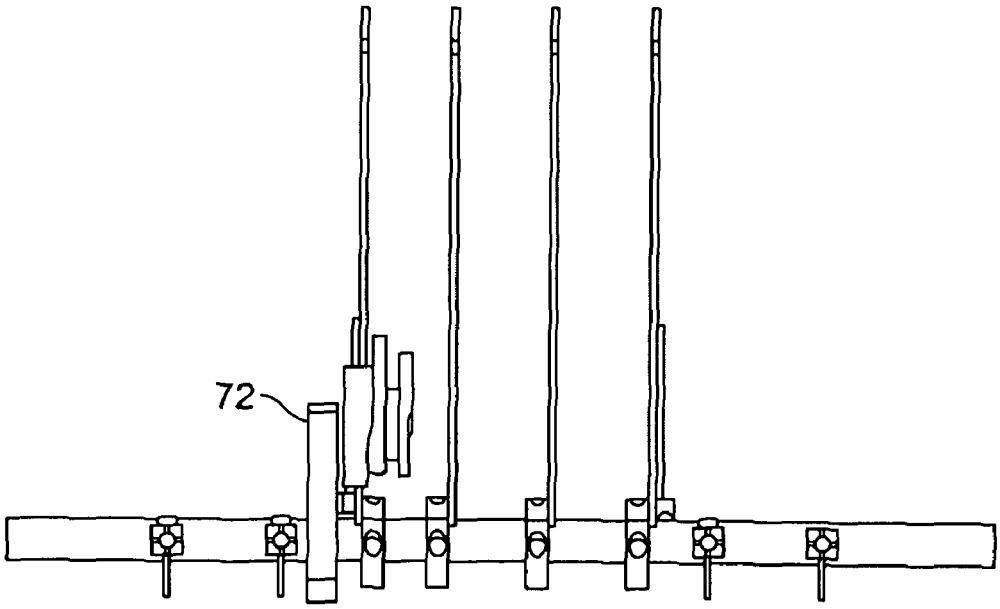
FIG. 6B shows an end view of the cam and a section of the gripper for the second drum.

As shown in FIG. 6A, cam mask 70 can fit over an existing cam of the cam 72 for the primary gripper 12 to cause the gripper 12 to close more quickly, and can be attached via a screw 73 and lock washer 74 and washer 75. The cam arm can be moved for example 0.25 inches towards a stitcher end to aid the gripper movement, as per FIG. 6B.

What is claimed is:

1. A method for retrofitting a saddle stitcher comprising:

retrofitting the saddle stitcher by adding an adjustable arced extension piece to a signature support of a first drum of a hopper for supporting a signature or sheet between the arced extension piece and the first drum of the hopper such that both the signature support and the arced extension piece support and contact the signature as the signature is transported on the first drum.

2. The method for retrofitting a saddle stitcher as recited in claim 1 further comprising the step of adjusting an angle of the arced extension piece with respect to the signature support or first drum.

3. The method for retrofitting a saddle stitcher as recited in claim 1 further comprising the step of adjusting a position of the arced extension piece with respect to the signature support or first drum.

4. The method for retrofitting a saddle stitcher as recited in claim 1 wherein the step of adding an adjustable arced extension piece includes mounting the arced extension piece to the signature support using washers and bolts.

5. The method for retrofitting a saddle stitcher as recited in claim 1 wherein the arced extension piece includes a slot.

6. The method for retrofitting a saddle stitcher as recited in claim 5 wherein the step of adding an adjustable arced extension piece includes passing a fastener through the slot to adjustably secure the arced extension piece to the signature support.

7. The method for retrofitting a saddle stitcher as recited in claim 6 further comprising sliding the extension circumferentially with respect to the first drum to vary the position of the fastener with respect to the slot.

8. The method for retrofitting a saddle stitcher as recited in claim 1 further comprising sliding the arced extension piece along the signature support to adjust an end position of the arced extension piece circumferentially with respect to the first drum.

9. The method for retrofitting a saddle stitcher as recited in claim 1 wherein after the adjustable arced extension piece is added to the signature support the arced extension piece extends circumferentially around the first drum such that the step of adding the adjustable arced extension piece effectively increases the circumferential length of the signature support.

10. The method for retrofitting a saddle stitcher as recited in claim 1 wherein after the adjustable arced extension piece is added to the signature support the arced extension piece and the signature support extend circumferentially around the first drum and are spaced from the first drum by the same distance.

11. The method for retrofitting a saddle stitcher as recited in claim 1 wherein the arced extension piece is added to the signature support between the first drum and a second drum of the saddle stitcher.

12. The method for retrofitting a saddle stitcher as recited in claim 1 further comprising removing a dipper blade and adding a dipper blade with a curved end, the curved end facing away from a direction of rotation of the first drum.

13. The method for retrofitting a saddle stitcher as recited in claim 1 further comprising adding a cam mask to a primary gripper cam controlling closing of a primary gripper on a second drum of the saddle stitcher, the cam mask causing the primary gripper to close more quickly.

14. The method for retrofitting a saddle stitcher as recited in claim 1 further comprising removing a primary gripper on a second drum of the saddle stitcher and adding a curved primary gripper with a curved end to the second drum, the curved end curving in a direction of rotation the second drum.

15. The method for retrofitting a saddle stitcher as recited in claim 1 further comprising adjusting an angle between a register stop and an end of the arced extension piece by sliding the arced extension piece relative to the signature support, the register stop being positioned at a circumference of the first drum.

16. The method for retrofitting a saddle stitcher as recited in claim 1 wherein the arced extension piece is added to the signature support at a position such that the first drum rotates the signature past a first end of the arced extension piece opposite of a second end of the arced extension piece that is adjacent to the signature support.

17. The method for retrofitting a saddle stitcher as recited in claim 16 wherein the arced extension piece is added to the signature support at a position such that as a lead edge of the signature contacts a register stop positioned at a circumference of the first drum a trailing edge of the signature is positioned past the first end of the arced extension piece.

18. The method for retrofitting a saddle stitcher as recited in claim 1 wherein the arced extension piece is added to the signature support at a position such that the extension piece supports a trailing edge of the signature as a gripper on the first drum grips a lead edge of the signature.

19. The method for retrofitting a saddle stitcher as recited in claim 1 wherein the arced extension piece is added to the signature support at a position such that the extension piece extends past the signature support in a direction that the first drum rotates during operation.

* * * * *

UNITED STATES PATENT AND TRADEMARK OFFICE

CERTIFICATE OF CORRECTION

PATENT NO. : 7,931,260 B2
APPLICATION NO. : 12/011112
DATED : April 26, 2011
INVENTOR(S) : James Aurthur Pangle et al.

It is certified that error appears in the above-identified patent and that said Letters Patent is hereby corrected as shown below:

Title page, item 57
The abstract should read:

"A method is provided for retrofitting a saddle stitcher comprising adding an arced extension piece to a signature support of a hopper. Other methods are also provided herein."

instead of

"A storage vessel for holding between shaves a wet razor with its head and cutting blade submerged in a liquid and its handle held out of the liquid and dry. The vessel liquid is comprised of a mixture of hydrophobic and hygroscopic materials and of anti-viral and anti-bacterial materials, effective to reduce cutting blade oxidation due to exposure to water and air during nonuse storage and to maintain the blade sharp and sanitary for shaving comfort. These materials specifically might be mineral oil and calcium chloride (CaCl2), and nano-gold or nano-silver."

Signed and Sealed this
Ninth Day of August, 2011

David J. Kappos

David J. Kappos
*Director of the United States Patent and Trademark Office*